United States Patent [19]

Morris et al.

[11] 4,170,769

[45] Oct. 9, 1979

[54] AUDIO-DETECTOR ALARM

[75] Inventors: James C. Morris, Wakefield, Mass.; Robert L. Garrison, Henniker, N.H.

[73] Assignee: GTE Sylvania Incorporated, Stamford, Conn.

[21] Appl. No.: 940,061

[22] Filed: Sep. 6, 1978

[51] Int. Cl.[2] ..... G08B 3/00; G08B 13/00

[52] U.S. Cl. ..... 340/384 E; 340/566

[58] Field of Search ..... 340/384 E, 565, 566; 331/65, 116 R

[56] References Cited

U.S. PATENT DOCUMENTS 3,739,299 6/1973 Adler ..... 340/384 E

*Primary Examiner*—Harold I. Pitts

*Attorney, Agent, or Firm*—Edward J. Coleman

[57] ABSTRACT

An intrusion alarm circuit including a single electro-acoustical transducer, such as a diaphragm-supported piezoelectric element, connected to an amplifier in a positive feedback loop configuration. The transducer functions as both a sound pickup and sound generator. When the ambient sound level exceeds a preselected threshold level, the resulting vibration of the transducer generates a voltage which activates the amplifier, whereupon the transducer vibrations are sustained and amplified in the manner of an oscillator, thereby producing an audible alarm.

11 Claims, 6 Drawing Figures

AUDIO-DETECTOR ALARM

RELATED PATENT APPLICATION

Ser. No. 940,062, filed Sept. 6, 1978, filed concurrently herewith, Andre C. Bouchard et al, "Intrusion Alarm System", assigned the same as this invention.

BACKGROUND OF THE INVENTION

This invention relates generally to transducers and, more particularly, to audio transducer circuits particularly useful in intrusion alarm systems.

Intrusion alarm systems employ various type means, such as trip mechanisms, electromagnetic fields, and ultrasonic generators and receivers, for detecting entry into a given area and triggering some form of an alarm signal. In some systems, the first order alarm signal may comprise a flash of light or a pulse code on a radio signal, while in other systems, the first order alarm may comprise a sound wave, such as a siren, whistle, or a bang. For example, copending applications Ser. Nos. 803,563 and 803,565, filed June 6, 1977 and assigned to the present assignee, describe a flashlamp assembly for providing intense audible and visual signals when triggered by an act of intrusion. The assembly utilizes percussive flashlamps which operate in conjunction with associated pyrotechnic devices located in proximity to the transparent housing of the flashlamp assembly. Each pyrotechnic device provides an audible signal (a bang) in response to energy received from a respective flashlamp when the lamp is fired.

The audio transducer circuit of the present invention is particularly useful for providing one or more second order alarms of a more sustained or varied capability as an optional add-on feature for supplementing the aforementioned first order sound-producing devices. For example, see the above-listed copending application Ser. No. 940,062. Particular advantages of certain of the above-mentioned first-order alarm devices are low cost, simplified structure, and compactness. Accordingly, it is an object of the present invention to provide a low cost, compact audio transducer circuit compatible with the aforementioned sound-producing devices of the first order in an intrusion alarm system. The circuit could be adapted to battery operation if desired. Further, for applications such as the aforementioned flashlamp-actuated pyrotechnic elements, the transducer circuit should be operative to generate a sustained alarm in response to a sound pulse of comparatively short duration.

SUMMARY OF THE INVENTION

These and other objects, advantages, and features are attained, in accordance with principles of this invention, by a circuit arrangement comprising an electroacoustical transducer and a switching amplifier coupled to a DC source, with the voltage output terminals of the transducer connected through a feedback path to the amplifier input and having the amplifier output coupled to the drive terminals of the transducer. The switching amplifier is biased to be normally nonconducting. Activation of the transducer by sound above a predetermined threshold level causes a voltage of sufficient magnitude to be applied to the amplifier to overcome the bias thereon and render the amplifier conducting. The resulting amplifier output causes the transducer to be driven into vibration, and the circuit proceeds to function as a threshold-triggered oscillator providing sustained generation of an audible alarm which can be terminated only by removal of the source power.

The circuit employs a single device, the electroacoustical transducer, as both a second detector and the sound-producing element. A device particularly useful as the transducer is a diaphragm-supported piezoelectric element, although other transducers, such as electrostatic and electromagnetic may be used as well. The transducer is held mechanically so that it is free to oscillate once it is set into motion from a noise or other disturbance. The transducer-amplifier remains normally in a quiescent state. If the transducer is disturbed from its resting position by a predetermined amount of noise or a direct mechanical perturbation, it will set the system, that is the amplifier and transducer, into a sustained oscillation producing an alarm signal. To further enhance the acoustical output from the transducer, it can be mounted within a Helmholtz acoustical resonant chamber.

The present invention contemplates a variety of circuit embodiments including the use of either two-terminal or three-terminal piezoelectric elements, and circuit arrangements which increase drive and reduce power consumption. The circuit can also be coupled to a controlled AC switch, such as a triac, arranged to activate an AC outlet when the oscillator-alarm circuit is activated, thereby driving other pieces of apparatus, such as louder alarms, television receivers, light bulbs, or radio transmitters for transmitting intrusion information to other areas.

BRIEF DESCRIPTION OF THE DRAWINGS

This invention will be more fully described hereinafter in conjunction with the accompanying drawings in which.

DESCRIPTION OF PREFERRED EMBODIMENT

Figure 1:
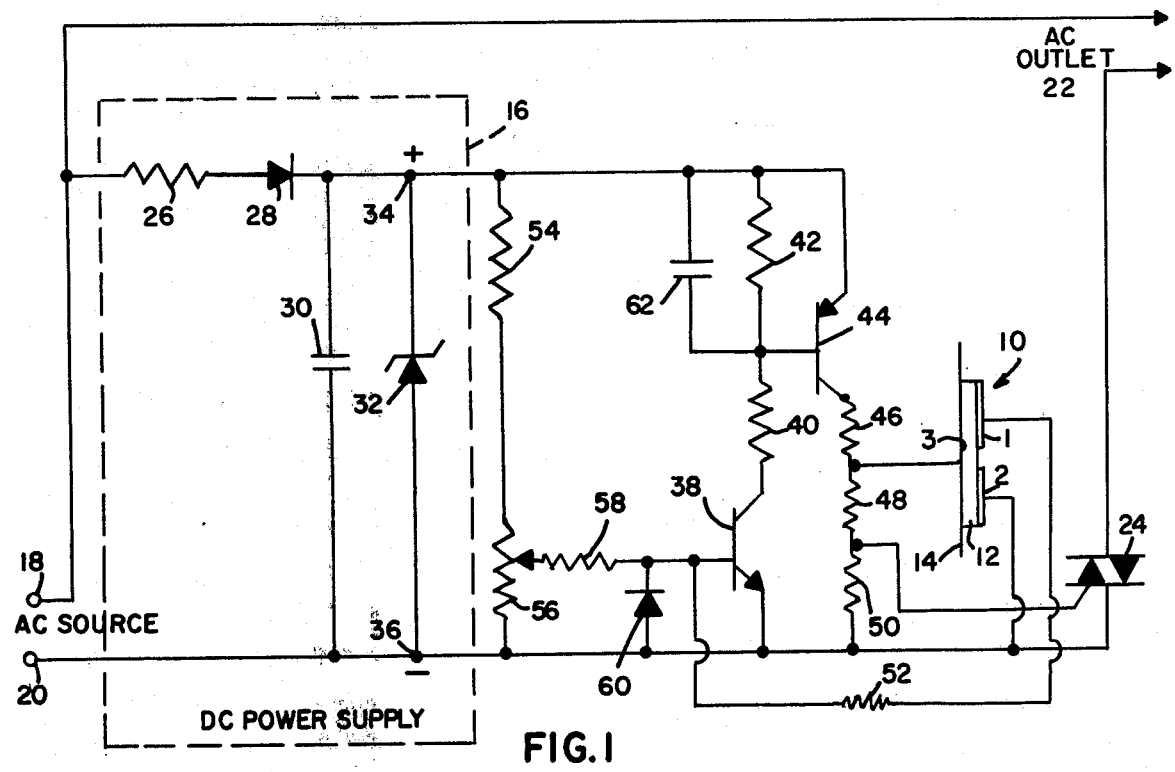
FIG. 1 is a schematic diagram of a first embodiment of an audio transducer circuit according to the invention, in which a 3-terminal piezoelectric element is employed.

Referring to FIG. 1, a first embodiment of a circuit according to the invention is shown in which the transducer element 10 is a three-terminal device. As discussed hereinbefore, the circuit is intended for application as a security alarm and comprises a sound pickup and sending device (the transducer) plus an AC switch. The device is placed in an area to be protected, and a noise from an intrusion activates the alarm and switch.

A particularly useful device for the electroacoustical transducer 10 is a diaphragm-supported piezoelectric element, such as that described in U.S. Pat. No. 3,815,129. Such a transducer includes a piezoelectric element 12 suitably bonded to a metal disc 14 which serves as a diaphragm. The piezoelectric element includes a piezoelectric crystal in the shape of a disc and terminals 1, 2, and 3 serving as electrodes comprised of thin sheets or coatings of electrically conductive material, such as silver, applied to the side of the crystal. A suitable material for the piezoelectric crystal would include a lead, zirconium, titanium composite, for example. The metal disc which serves as the diaphragm of the transducer may be fabricated from a metal such as brass.

In FIG. 1 the transducer is shown in combination with a switching amplifier circuit powered by a source of DC voltage 16. Although the DC supply 16 may comprise a battery, in this instance it is illustrated as comprising a rectifier circuit energized from a source of AC voltage represented by terminals 18 and 20. The AC terminals not only provide a source of power for rectifier circuit 16 but are also connected to an AC outlet 22. More specifically, AC terminal 18 is connected directly to one side of the AC receptacle 22, while AC terminal 20 is connected through a controlled switching device, such as triac 24, to the other side of the AC outlet.

Rectifier circuit 16 comprises a series resistor 26 and diode 28 connected to a positive terminal junction with parallel connected filter capacitor 30 and Zener diode 32. In a preferred embodiment, a 125 volt AC input is applied to terminals 18 and 20, and Zener diode 32 is selected to regulate the voltage of the DC supply at about 30 volts. This permits a more precise and reproducible adjustment to the level of noise or mechanical disturbance needed to initiate the alarm. The positive and negative terminals of the DC supply 16 are represented by terminals 34 and 36, respectively.

The oscillator circuit includes a first switching amplifier comprising a transistor 38 having collector-emitter electrodes connected in series with a voltage divider, comprising resistors 40 and 42, across the DC terminals 34 and 36. Also connected across the DC supply terminals is a circuit combination comprising a second switching amplifier consisting of transistor 44 having a base electrode connected to the junction of resistors 40 and 42, an emitter electrode connected to DC terminal 34, and a collector electrode connected to the DC terminal 36 through a voltage divider comprising resistors 46, 48, and 50. The junction of resistors 46 and 48 is connected to drive terminal 3 of the transducer, while the voltage output terminals 1 and 2 of transducer 10 are coupled in a positive feedback path to the input of the first switching amplifier, transistor 38. More specifically, terminal 2 is connected to the reference line from DC terminal 36, and transducer terminal 1 is connected through a resistor 52 to the base of transistor 38.

The first switching amplifier, transistor 38, is biased to be normally nonconducting by a circuit including resistors 54 and 56, which are series connected across DC terminals 34 and 36, and a resistor 58 connected in series between the base of transistor 38 and resistor 56. When transistor 38 is in a nonconducting state, transistor 44 is also biased to be nonconducting. Resistor 56 may have a fixed value or, as illustrated, it may comprise a potentiometer, in which case resistor 58 is connected to the variable tap on optentiometer 56. The base bias circuit of the first amplifier is completed by a diode 60 connected as illustrated across the base and emitter electrodes of transistor 38. Diode 60 serves two purposes: (1) to aid in the leakage or the discharge of the voltage developed between terminals 1 and 2 of the transducer; and (2) it also serves to reduce the possibility of breakdown voltages reaching the base to emitter junction of transistor 38. As will be made clear hereinafter, the bias on transistor 38, which may be selectably adjusted by potentiometer 56, is the means by which the predetermined threshold level of the circuit is selected. Detection of sound above this predetermined threshold level triggers the circuit into oscillation.

Resistors 48 and 50 are chosen to have a time constant in combination with the capacitance of the piezoelectric element 12 to allow the voltages developed on terminals 2 and 3 to discharge rapidly enough during the off time of transistors 38 and 44 so that the transducer can restore itself to its original position and carry beyond that to the reverse position, as shall be made clear hereinafter. Coupling resistor 52 is chosen to suppress undesired oscillations at frequencies other than the basic frequency of the piezoelectric crystal. A capacitor 62 is connected across resistor 42, and thus across the base-emitter junction of transistor 44, to reduce the frequency response of transistor 44 so that this second switching amplifier will not respond to line transients and radio frequency pickup as readily as it would if that capacitor were not included.

The oscillator circuit provides control of AC switch 24 by means of a connection between the junction of resistors 48 and 50 and the control gate of triac 24.

The diaphragm-supported piezoelectric element comprising transducer 10 is held mechanically so that it is free to oscillate once it is set into motion from a noise or other disturbance. As described, the piezoelectric element is electrically connected to the switching amplifier arrangement in a positive feedback loop configuration. If the device is disturbed from its resting position by a predetermined amount of noise or a direct mechanical perturbation, it will set the system, that is, the amplifier and piezoelectric element, into a sustained oscillation producing an alarm signal. The device can only be shut off by removing the power from terminals 34 and 36, or terminals 18 and 20.

Figures 2A, 2B, 2C:
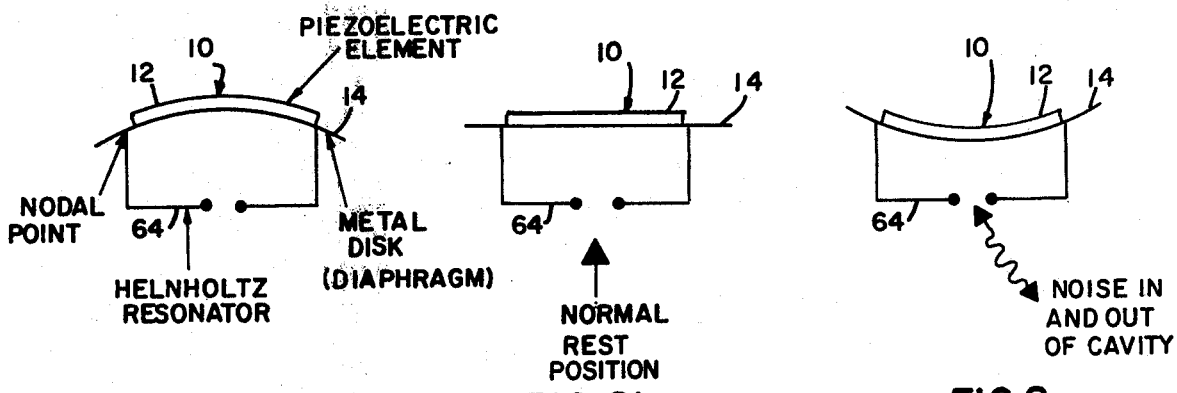
FIGS. 2 (*a*), (*b*) and (*c*) are simplified diagrams illustrating three different positions of a diaphragm-supported piezoelectric element during the oscillation thereof as mounted on a Helmholtz resonator.

Referring to the diagrams of FIGS. 2(*a*), (*b*), and (*c*), the transducer 10, comprising piezoelectric element 12 supported on a flexible metal disc 14, serving as a diaphragm, is illustrated in three different positions of its motion during oscillation of the circuit according to the invention. In the preferred embodiment illustrated, the transducer 10 is shown as mounted in a Helmholtz resonator 64, which enhances the acoustical output from the transducer. For example, a transducer assembly comprising a piezoelectric element mounted in a Helmholtz acoustical resonant chamber is described from U.S. Pat. No. 4,042,845.

In operation, noise from an intrusion is detected by the piezoelectric element 12, thereby setting the transducer 10 into motion. This motion creates a voltage on terminals 1 and 2. The voltage from terminals 1 and 2 is applied across the base-emitter junction of transistor 38. If of a sufficient magnitude to overcome the threshold bias on transistor 38, the transducer output voltage is operative to turn on transistor 38 to render it conducting. Hence, when transistor 38 is switched to a conducting state, the resulting voltage provided by divider resistors 42 and 40 at the base of transistor 44 functions to switch this second amplifier into a conducting state. With transistor 44 turned on, the voltage from the DC supply 16 is applied across the resistor divider 46–50, which in turn impresses a voltage across the transducer drive terminals 3 and 2. This drive voltage amplifies the motion of the transducer, which was originally started with the intrusion noise. Hence, whereas the normal rest position of transducer 10 is as illustrated in FIG.

2(*b*), the noise-induced amplified position of the transducer will now be as illustrated in, say, FIG. 2(*a*). The driving voltage from the amplifier circuit forces the deflection of the transducer to a position that balances the mechanical spring forces of the metal disc 14 with the piezoelectric forces exerted on the transducer from the power supply. It is also possible, because of enertia of metal disc 14, that the motion of the transducer will be carried beyond this balancing force. In the meantime, the voltage which first occurred across terminals 1 and 2 of the transducer is reduced by leakages through the base to emitter junction of transistor 38 and diode 60. When this voltage drops sufficiently low, it turns off transistor 38 and thus transistor 44. The charge left across terminals 2 and 3 of the transducer, which was delivered during the driving part of the cycle, now discharges through resistors 48 and 50. The transducer mechanically relaxes from its maximum-driven deflection, see FIG. 2(*a*), returns back to the neutral position, see FIG. 2(*b*), and is carried by inertia to a reverse deflection, see FIG. 2(*c*). This latter movement creates a voltage at the various terminals of the transducer which are reversed to the original driven condition. This voltage further biases off transistor 38. The transducer now deflects until the kinetic energy of the mechanical system is converted to potential energy, at which time it stops its swing and starts back through the reverse position going to the netural point and completing the cycle. On the return to its original position, the voltage developed across terminals 1 and 2 is now of the correct polarity and magnitude to turn on transistor 38 and transistor 44, further driving the transducer again, and thus completing one full cycle.

In a preferred embodiment, the frequency of the oscillations for an audio type alarm are in the neighborhood of 2 to 3 KHz. The circuit may also be designed, however, such that the oscillations are at ultrasonic frequencies above the normal hearing of humans to transmit information to other pickup devices. On the other hand, if the output is in the audible range, the device serves as an alarm in its own right. As previously mentioned, to further enhance the acoustical output from the transducer, a Helmholtz acoustical resonator can be coupled to the device.

In addition to activating the transducer alarm, the voltage developed across resistor 50 during the conducting state of transistor 44 is applied to the control gate of triac 24. The pulses of voltage from this connection to the gate of the triac are sufficient to turn on the triac to a conducting state whereby the AC source 18, 20 is conductively connected to the output receptacle 22. This AC outlet 22 controlled by switch 24 can then be employed to drive other pieces of apparatus such as louder alarms, television receivers, light bulbs or radio transmitters for transmitting intrusion information to other areas.

Figure 3:
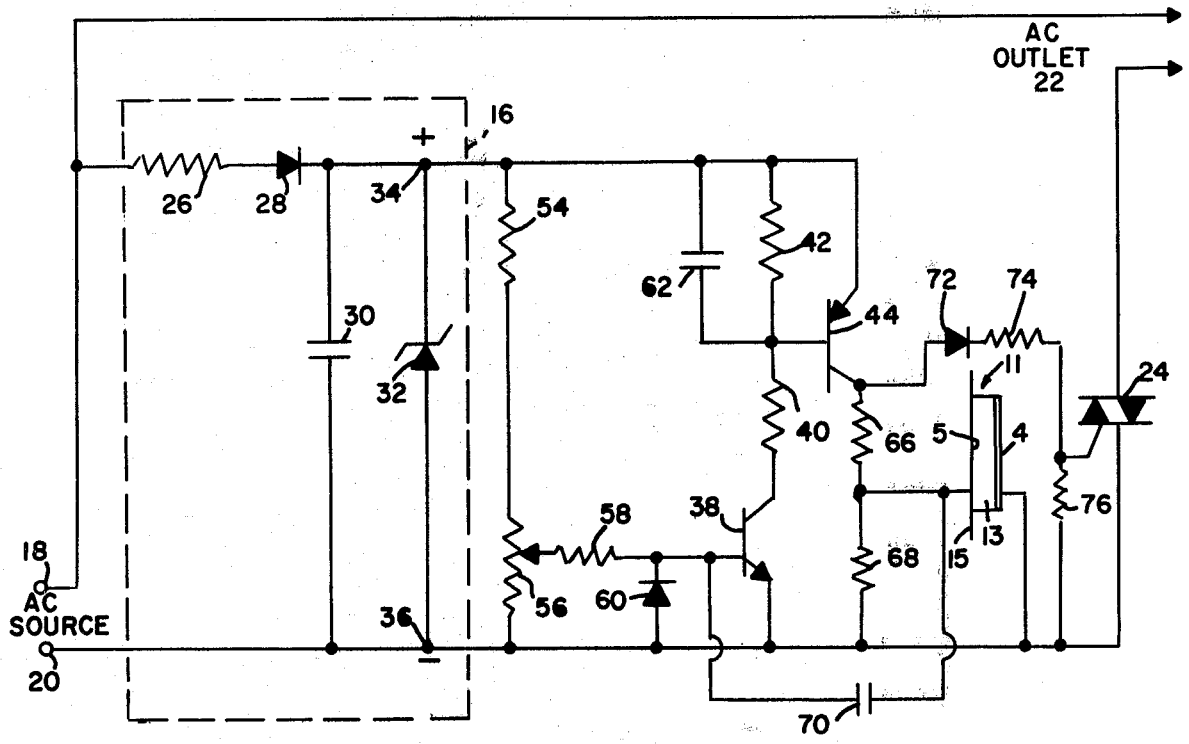
FIG. 3 is a schematic diagram of a second embodiment of the invention in which a 2-terminal piezoelectric element is employed.

FIG. 3 shows an alternative embodiment of a transducer circuit according to the invention in which a transducer 11 is employed which does not include a feedback tap. That is, the device 11 employs a piezoelectric element 13 having only two terminals, 4 and 5 respectively, and mounted on a diaphragm 15. All circuit elements in FIG. 3 labeled with the same identifying numberals as respective elements of FIG. 1 have the same values and functions as the corresponding circuit components of FIG. 1. In the case of FIG. 3, however, the voltage divider connected between the collector of transistor 44 and negative terminal 36 comprises resistors 66 and 68, the junction of which is connected to terminal 5 of transducer 11. Transducer terminal 5 is also connected through an AC coupling capacitor 70 to the base of transistor 38. Terminal 4 of the transducer is connected to the negative terminal 36 of the DC supply. With this arrangement, the voltage pulses of the vibrating transducer are coupled through capacitor 70 to turn on transistor 38, which when conducting, also causes transistor 44 to be switched to a conducting state. The resulting voltage at the junction of resistors 66 and 68 is then applied to drive terminal 5 of the transducer. Hence, terminal 5 provides both drive and output functions for the transducer. Capacitor 70 serves to block any DC flow between terminal 5 and the base of transistor 38.

The voltage pulses for the control gate of triac 24 are provided by a series circuit arrangement connected between the collector of transistor 44 and negative terminal 36 and comprising a diode 72 for isolating electrical noise on the AC line, a resistor 74 and a resistor 76. The control gate of switch 24 is connected to the junction of resistors 74 and 76.

Figure 4:
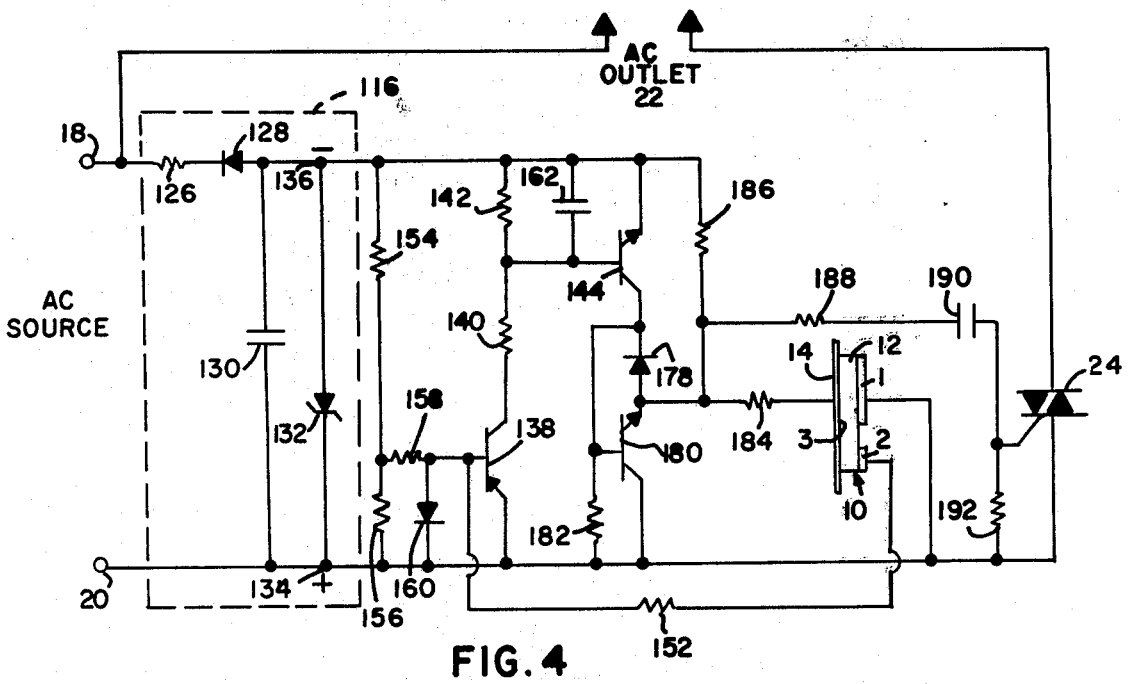
FIG. 4 is a third embodiment of a transducer circuit according to the invention which is modified to provide increased drive with reduced power consumption.

FIG. 4 shows yet another embodiment of a transducer circuit according to the invention which offers the advantages of increased drive and reduced power consumption over the embodiments of FIGS. 1 and 3. The circuit arrangement of FIG. 4 is somewhat similar to that of FIG. 1 in that a DC supply and amplifier arrangement is used in conjunction with a transducer 10 comprising the three-terminal piezoelectric element 12 mounted on diaphragm 14. In FIG. 4, however, the polarities are reversed and a two-transistor arrangement is used between the first switching amplifier and the transducer. Whereas in FIG. 1, transistor 38 was an NPN type, the corresponding transistor 138 in FIG. 4 is a PNP type, and whereas transistor 44 of FIG. 1 was a PNP type, the corresponding transistor 144 of FIG. 4 is an NPN type.

Referring to FIG. 4, terminals 18 and 20 of the AC source are connected to a DC power supply 116 and through triac 24 (connected to terminal 20) to an AC outlet 22. The DC supply comprises resistor 126, diode 128, filter capacitor 130 and Zener diode 132 connected as illustrated. Accordingly, terminals 134 and 136 represent the positive and negative outputs, respectively, of the DC supply. Transistor 138 is connected in series with divider resistors 140 and 142 across the DC output, and the base of transistor 138 is connected to a bias circuit including resistors 154, 156, and 158 and diode 160 connected as illustrated. The base of transistor 144 is connected to the junction of resistors 140 and 142. Terminal 1 of the transducer 10 is connected to the positive DC terminal 134, and transducer terminal 2 is coupled through a resistor 152 to the base of transistor 138. Resistor 152 functions in the same manner as resistor 52 of FIG. 1, and noise activation of transducer 10 produces a sufficient voltage which, when applied to the base of transistor 138 via resistor 152, causes transistor 138 to be rendered conducting. The conduction of transistor 138 in turn causes transistor 144 to be switched to a conducting state. Capacitor 162, connected across the emitter base junction of transistor 144, performs the same function as capacitor 62 of FIG. 1.

In the case of FIG. 4, the remaining circuitry is modified as follows. The emitter-collector of transistor 144 is connected in series with a diode 178 and the emitter-collector of an NPN transistor 180 across the DC supply, the anode of diode 178 being connected to the emitter of transistor 180, and the cathode of the diode being connected to the collector of transistor 144. Hence, the function of diode 178 is to keep transistor 180 in a nonconducting state (turned off) when transistor 144 is conducting (turned on). The collector of transistor 144 is also connected to the base of transistor 180 and through a resistor 182 to the positive DC terminal 134. This base circuit arrangement of transistor 180 assures that this transistor is rendered conducting (turned on) when transistor 144 is rendered nonconducting (turned off).

The emitter of transistor 180 is also connected through a resistor 184 to terminal 3 of transducer 10 and through a resistor 186 to the negative DC terminal 136. In operation, therefore, when the output of the transducer causes transistor 138 to be turned on, thereby causing transistor 144 to be switched to the conducting state, transistor 180 will remain turned off and a drive voltage will be applied via resistor 184 to terminal 3 of the transducer. When the direction of transducer deflection reverses, and thereby causes transistors 138 and 144 to be turned off, transistor 180 will be switched to a conducting state, thereby rapidly discharging the stored energy in the piezoelectric element of transducer 10. This rapid discharge function of the alternately conducting transistor 180 has the effect of increasing the drive on the transducer element and reducing the overall power consumption of the oscillator circuit.

Activation of the control gate of triac 24 is provided by a series output arrangement comprising resistor 188, capacitor 190, and resistor 192, connected in that order between the emitter of transistor 180 and the positive DC terminal 134. The control gate electrode of switch 24 is connected to the junction of resistor 192 and capacitor 190. The purpose of capacitor 190 is to shorten the gating pulse applied to triac 24 when transistor 144 is conducting, thereby further reducing power consumption.

Although the described transducer circuits can be made using component values in ranges suitable for each particular application, as is well known in the art, the following table lists component values and types for one transducer circuit (FIG. 4) made in accordance with the present invention.

| | |
|---|---|
| Piezoelectric sound transducer 10 | Gulton P.N. 101 FB/G 1512 CATT, frequency 2900 Hz |
| Controlled switch 24 | Triac Teccor type Q2004F312 200 volts, 4 amps. |
| Resistor 126 | 3.3 K ohms., 2 watts |
| Diode 128 | 1N4004 |
| Capacitor 130 | 47 microfarad, 63 volts |
| Zener Diode 132 | 1N4753 |
| Transistor 138 | 2N3906 |
| Resistors 140, 152, 182, and 186 | 10 Kohms., ¼ watt |
| Transistors 144 and 180 | 2N3904 |
| Resistor 142 | 1 K ohm., ¼ watt |
| Resistor 154 | 100 K ohms., ¼ watt |
| Resistors 156 and 188 | 2 K ohms., ¼ watt |
| Resistor 158 | 1 Megohm., ¼ watt |
| Diodes 160 and 178 | 1N4148 |
| Capacitor 162 | 0.047 microfarad, 25 volt ceramic |
| Resistor 184 | 120 ohms., ½ watt |
| Capacitor 190 | 0.01 microfarad ± 20%, 100 volts |
| Resistor 192 | 220 ohms, ¼ watt |

Although the invention has been described with respect to specific embodiments, it will be appreciated that modifications and changes may be made by those skilled in the art without departing from the true spirit and scope of the invention.

What we claim is:

1. An audio transducer circuit responsive to the detection of sound above a predetermined threshold level for producing an alarm, said transducer circuit comprising:

an electroacoustical transducer having a plurality of terminals;

a source of DC voltage;

a first switching amplifier coupled to said DC source and biased to be normally nonconducting;

means coupling voltage output terminals of said transducer to the input of said first amplifier whereby activation of said transducer by sound above said predetermined threshold level causes a voltage of sufficient magnitude to be applied to said first amplifier to overcome the bias thereon and render said first amplifier conducting, said threshold level thereby being determined by the selected bias of said first amplifier; and means coupling the output of said first switching amplifier to drive terminals of said transducer, said circuit thereby forming a threshold triggered oscillator.

2. The circuit of claim 1 further including a source of AC voltage, an AC outlet, a controlled switch connected between said AC source and AC outlet and having a control terminal for rendering said switch conductive in response to a voltage signal applied thereto, and means coupling the output of said first amplifier to said control terminal of said switch.

3. The circuit of claim 2 wherein said DC source comprises a rectifier means coupled to said AC source.

4. The circuit of claim 1 wherein said last-mentioned coupling means comprises a second switching amplifier and a first voltage divider connected across said DC source, the output of said first amplifier being coupled to the input of said second amplifier, said second amplifier being biased to be nonconducting when said first amplifier is nonconducting and to be rendered conducting when said first amplifier is conducting, and said voltage divider being coupled to drive terminals of said transducer.

5. The circuit of claim 4 wherein said transducer comprises a diaphragm-supported piezoelectric element having a plurality of terminals; said first and second switching amplifiers respectively comprise first and second transistors, each having base, collector and emitter electrodes; said DC source has first and second terminals; a second voltage divider and the collector-emitter of said first transistor are series connected in that order across the first and second terminals of said DC source; the base of said second transistor is connected to said second divider; the emitter-collector of said second transistor and said first divider are series connected in that order across the first and second terminals of said DC source; and said means coupling the transducer output to the input of said first amplifier includes means connected between a terminal of said transducer and the base of said first transistor.

6. The circuit of claim 5 wherein the bias for said first transistor amplifier is rendered adjustable by a potentiometer coupled across the terminals of said DC source and having a variable tap coupled to the base of said first transistor, said potentiometer enabling the selection of said predetermined threshold level.

7. The circuit of claim 5 wherein said transducer has first, second and third terminals; said means coupling the transducer output to the input of said first amplifier includes a resistor connected between the first terminal of said transducer and the base of said first transistor, and means connecting the second terminal of said transducer to the second terminal of said DC source; and the third terminal of said transducer is connected to said first divider.

8. The circuit of claim 5 wherein said transducer has first and second terminals; said means coupling the transducer output to the input of said first amplifier includes a capacitor connected between the first terminal of said transducer and the base of said first transistor, and means connecting the second terminal of said transducer to the second terminal of said DC source; and said first terminal of said transducer is also connected to said first divider.

9. The circuit of claim 5 wherein said transducer is mounted within a Helmholtz acoustical resonant chamber.

10. The circuit of claim 1 wherein said transducer comprises a diaphragm-supported piezoelectric element having first, second, and third terminals; said first switching amplifier comprises a first transistor having base, collector and emitter electrodes; said DC source has first and second terminals; a voltage divider and the collector-emitter of said first transistor are series connected in that order across the first and second terminals of said DC source; said last-mentioned coupling means comprises second and third transistors each having base, collector, and emitter electrodes, and a diode, the emitter-collector of said second transistor, said diode, and the emitter-collector of said third transistor being series connected in that order across the first and second terminals of said DC source, the base of said second transistor being connected to said divider, and the junction of said diode and the collector of said second transistor being connected to the base of said third transistor and through a first resistor to the second terminal of said DC source, said second transistor being biased to be nonconducting when said first transistor is nonconducting and to be switched to a conducting state when said first transistor is switched to a conducting state, said diode maintaining said third transistor in a nonconducting state when said second transistor is conducting, and said base connections of said third transistor rendering said third transistor conducting when said second transistor is nonconducting; said means coupling the transducer output to the input of said first amplifier includes a second resistor connected between the first terminal of said transducer and the base of said first transistor, and means connecting the second terminal of said transducer to the second terminal of said DC source; and the third terminal of said transducer is connected through a third resistor to the emitter of said third transistor, said emitter of the third transistor being connected through a fourth resistor to the first terminal of said DC source.

11. The circuit of claim 10 further including a source of AC voltage, an AC outlet, a controlled switch connected between said AC source and AC outlet and having a control terminal for rendering said switch conductive in response to a voltage pulse applied thereto, a fifth resistor, a capacitor and a sixth resistor series connected in that order between the emitter of said third transistor and the second terminal of said DC source, and means connecting the junction of said capacitor and sixth resistor to the control terminal of said switch.

* * * * *